US005211692A

United States Patent [19]

Lalvani

[11] Patent Number: 5,211,692

[45] Date of Patent: May 18, 1993

[54] METAMORPHIC TILING PATTERNS BASED ON ZONOHEDRA

[76] Inventor: Haresh Lalvani, 164 Bank St., Apt. 2B, New York, N.Y. 10014

[21] Appl. No.: 573,857

[22] Filed: Aug. 28, 1990

[51] Int. Cl.[5] ..... B44F 7/00

[52] U.S. Cl. ..... 273/157 R; 52/311.2

[58] Field of Search ..... 52/311; 273/157 R, 156

[56] References Cited

PUBLICATIONS

J. L. Locher, *The World of M. C. Escher,* (Abrams, 1971), pp. 111–112, 116.

Douglas R. Hofstadter, *Scientific American* (Jul. 1983), pp. 14–20.

*Primary Examiner*—Henry E. Raduazo

[57] ABSTRACT

This application discloses a tiling system for surfaces where the pattern of the tiling changes continuously from one portion of the tiling to another in an Escher-like metamorphoses with the difference the the metamorphoses are based on binary combinations of n transformations on the edges of the tile. Accordingly, the tiling is obtained from the n directions of the edges of an underlying zonohedron, a polyhedron derived as a projection of an n-dimensional cube. The zonohedron provides a hidden network for the continuous transformations of the tiles to one another. The derived designs utilize 3- and 4-sided polygons and have a variety of curved edges in and across the plane of the tile. The metamorphic designs provide visually attractive alternatives to periodic patterns used as architectural surfaces, walls, floors, ceilings, window screens and dividers, architectural space enclosures, visual art, textile designs and computer graphics amongst other varied applications.

19 Claims, 10 Drawing Sheets

1
2
3
4

5
6
7
8
aa
ab
ba
bb aaaa
aaab
aaba
aabb
abaa
abab
abba
abbb
baaa
baab
baba
babb
bbaa
bbab
bbba
bbbb
9
10 fig. 4
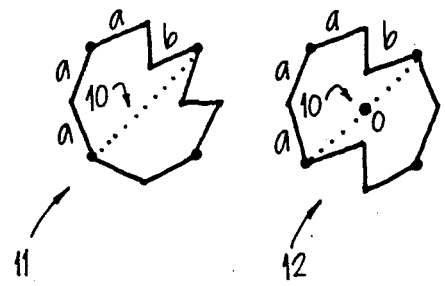
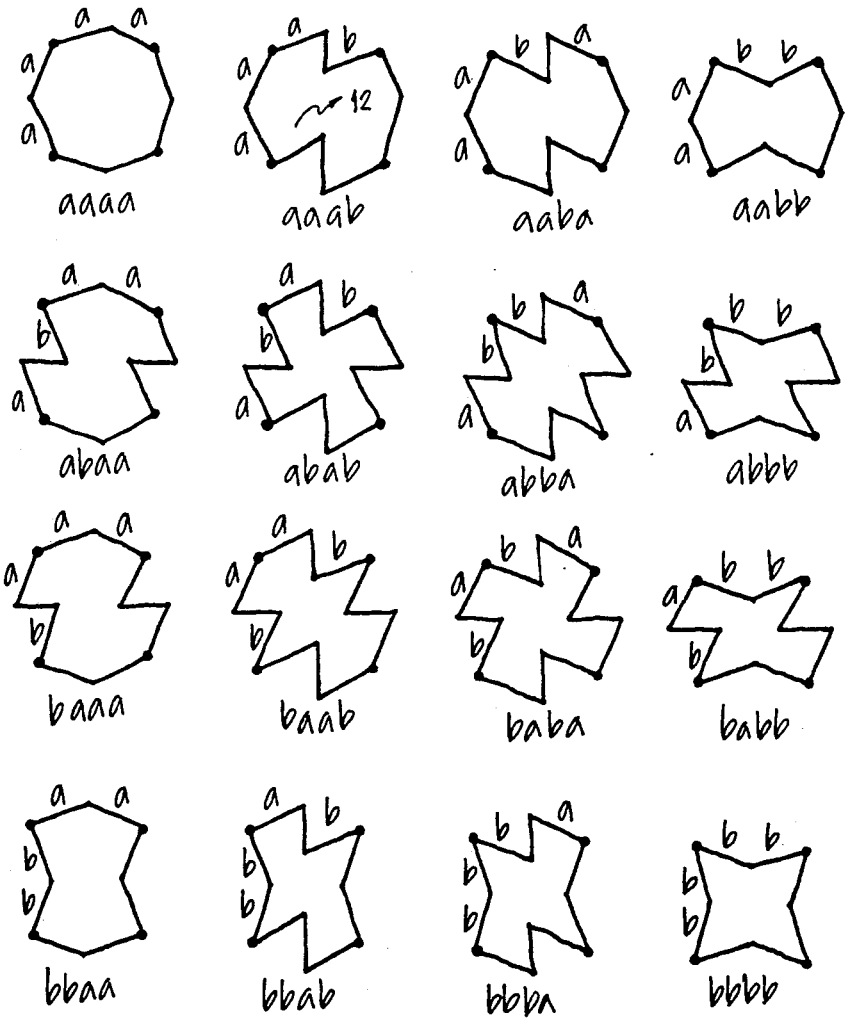
fig. 5

METAMORPHIC TILING PATTERNS BASED ON ZONOHEDRA

THE FIELD OF INVENTION

The present invention relates to tilings patterns for surfaces. The tiling patterns transform from one portion of the pattern to the other by gradual changes in the shape of each tile. Such tiling patterns, here termed "metamorphic tiling patterns" are based on 2- and 3-dimensional projections from n-dimensions. They are obtained by tiling the faces of zonogons and zonohedra.

BACKGROUND OF THE INVENTION

The celebrated Dutch graphic artist, M. C. Escher, made a unique contribution to the art of pattern-making through his continuous metamorphic designs. His works, *Metamorphosis III, or Verbum*, show this skill amply. In *Metamorphosis III*, a long linear scroll, he begins with a simple geometric "day-and-night" (alternating black and white) pattern on the left. As he proceeds to the right, he gradually transforms each "tile" or polygon very slightly. This transformation increases as one moves to the right and eventually the original tiles completely change to another set of tiles. One pattern changes to another in the process. In *Metamorphosis III* he does this continually and goes from one pattern change to another in the same illustration.

Metamorphic tiling patterns provide useful and visually interesting applications as architectural patterns in buildings, as floor and wall tiles, as ceiling lattices or window screens, as partitions, textile patterns, layout of buildings or in landscape designs. The tiling patterns could be used in various crafts, art works, brick designs, or as toys and puzzles.

Prior art include's Escher's metamorphic tiling patterns which are well known from his graphic prints and publications on his work. Prior art, like Escher's, is restricted to linear transformations, i.e. transformations along one direction as in Escher's *Metamorphosis III*, transformational patterns on a square, i.e. transformations along two simultaneous directions, and transformational patterns on a regular hexagon, i.e. transformations along three directions as in Escher's Verbum. The use of higher dimensions for deriving transformational tiling patterns is not known in prior art. The present invention shows a generalization of metamorphic tiling patterns by projection from n-dimensions into 2- or 3-dimensions. This is not trivial. The present invention uses 2-dimensional projection of an n-dimensional cube as an underlying or "hidden" network, hereafter termed "network", for deriving continuous pattern transformations. The tilings derived can be termed "Hyper-Escher" patterns.

More specifically, zonogons (in 2-dimensions) and zonohedra (in 3-dimensions), which are embedded in the n-cube and are like its "shadows" are used as networks instead of the entire n-dimensional cube. This is to avoid over lapping tiling patterns which will result if the entire n-cube were used. In the 2-dimensional case this leads to zonogons, or 2n-sided polygons having their opposite edges parallel to one another, which are divided into different rhombii or paralellograms. When divided thus, the zonogon is in fact a 2-dimensional view of a zonohedron, a polyhedron with $n(n-1)$ faces in parallel pairs. This zonohedron is used as network to generate Escher-like metamorphic designs. Since n can be any number, such patterns are an infinite class. In the 3-dimensional case, the rhombic or paralellogram faces of a zonohedron, are used as a starting point.

The tiling patterns could be suitably colored. The color scheme could itself reflect the idea of metamorphosis and the tiles could be graded in color. This means n tranformations would require n different colors in binary combinations. Thus, as the shape of the tile changes, so does its color.

One example of the derivation of metamorphic tiling patterns using this method is described in detail. This example shows a tiling based on 4 transformations on a single edge of a tile. In addition, the tiles shown in this particular example are all 4-sided. The array of these 4-sided polygons uses a "base" square grid (shown later in FIG. 10 by a graph, and in FIGS. 11 and 13 by an array of black dots). Each "base polygon" of this grid is a square. This "base grid" is also hidden and is superimposed on the zonohedron network. Further, in the example shown, the zonohedron network has a true 4-fold symmetry which happens to match with the symmetry of the base grid.

It will be clear that other matamorphic tilings can be derived in this manner. The base polygons need not be squares, and any rectangle, rhombus or a parallelogram could be used. In addition, the base grid need not be a square grid and could be based on the arrays of different base polygons. The edges could use other types of transformations and could be curved in various ways. The tile could be made 3-dimensional in various ways. The zonohedron network could use other paralellograms or rhombii with different angles, and its dimension could be greater than 4.

DRAWINGS

Referring to the drawings which form a part of this original disclosure:

Figures 1, 2, 3:
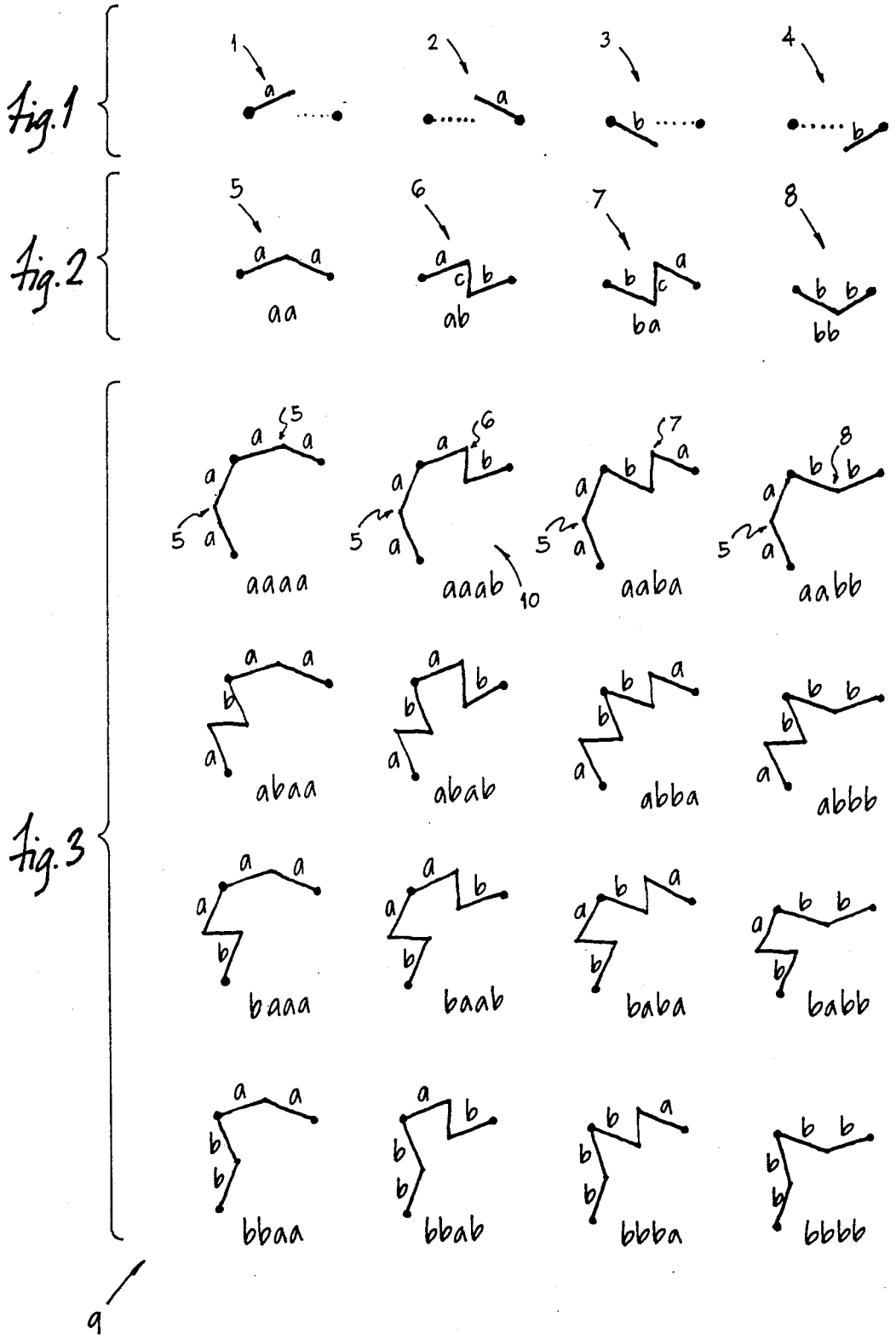
FIG. 1 shows two states each of the left and right half-edge of a polygonal tile; the half-edge (a) is turned upwards, the half-edge (b) is turned downwards.
FIG. 2 shows four combinations of half-edges of FIG. 1, namely (aa), (ab), (ba) and (bb); each pair of half-edges leads to a full edge of a polygonal tile.
FIG. 3 shows a matrix of 16 two-edge configurations; each structure is composed of a pair of edges from FIG. 2. The 16 are arranged as a multiplication table.

FIG. 4 shows two polygons obtained by symmetry operations on the two-edge combination (aaab) from the 16 in FIG. 3. On the left is a reflection, on the right is a 2-fold rotation on the same two-edge combination. The dotted line separates the two halves.

FIG. 5 shows a matrix of 16 4-sided polygons, where each polygon is derived by a 2-fold rotation of the 16 two-edge combinations of FIG. 3. FIGS. 3 and 5 correspond exactly to one another.

Figure 6:
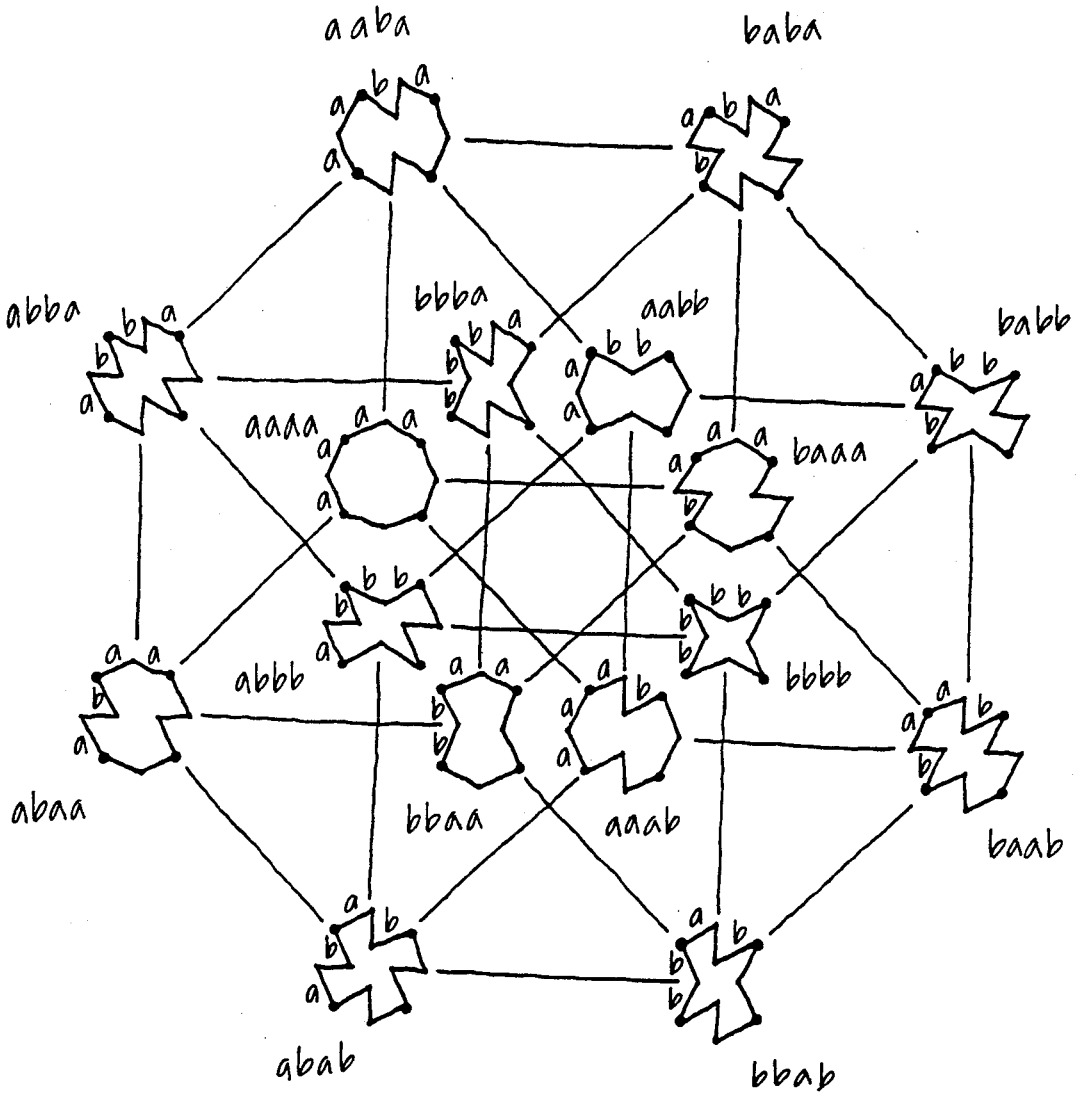

FIG. 6 shows an alternative arrangement of the 16 4-sided polygonal tiles in FIG. 5. Here the 16 are arranged on the vertices of a 4-dimensional cube viewed along its 4-fold axis and projected in 2-dimensions.

Figure 7:
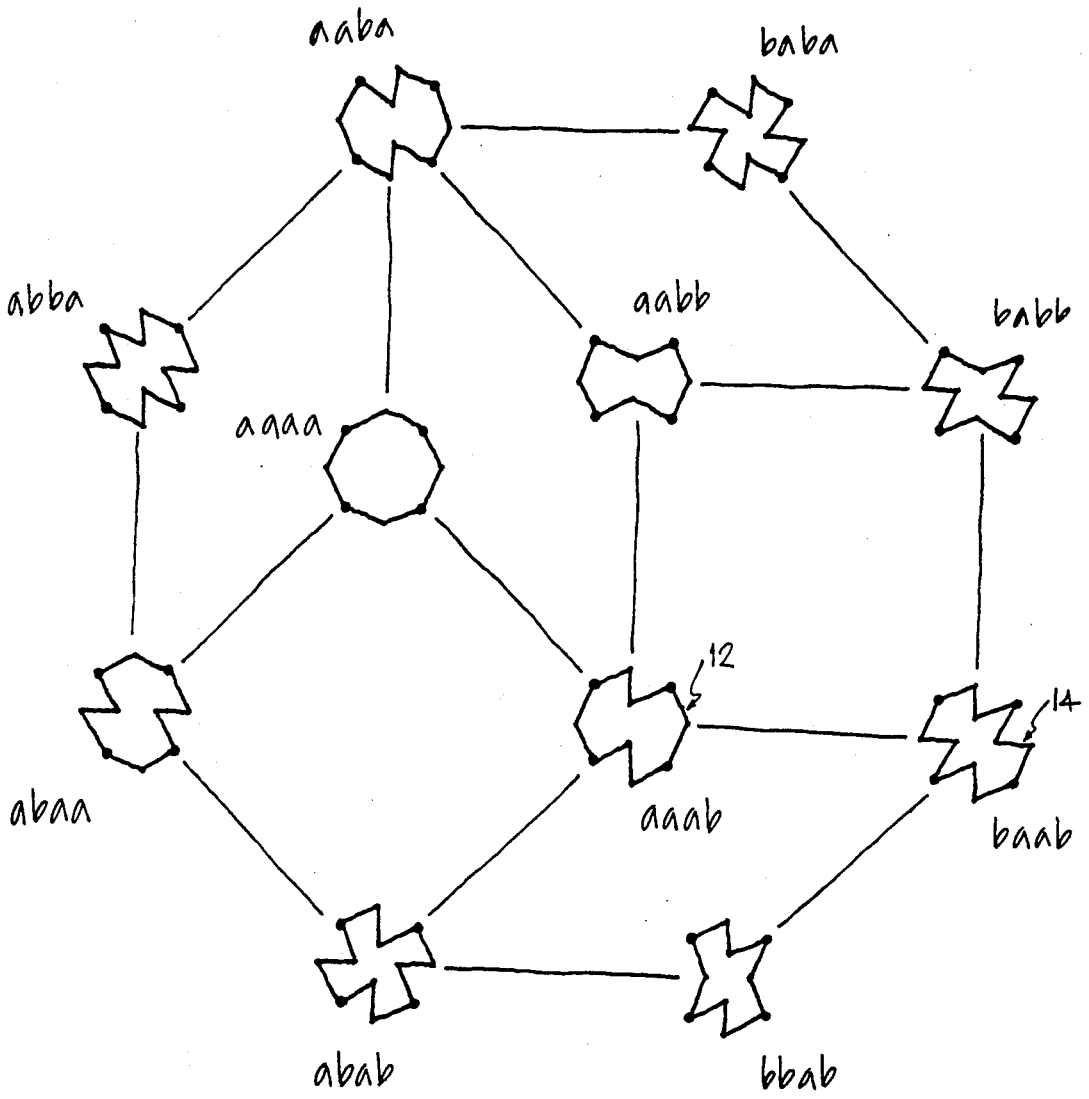

FIG. 7 shows 11 of the 16 tiles of FIG. 6. By eliminating the overlapping rhombii of FIG. 6, a 2-dimensional view of a zonohedron is obtained. The 11 polygons now lie on the vertices of a zonohedron projected in 2-dimensions.

FIG. 8 shows a continuous transformation of a single edge of a polygonal tile. As an example the edge (aa) is shown to transform to the edge (ba) through 3 intermediate stages (a'a), (αa) and (b'a).

Figure 9:
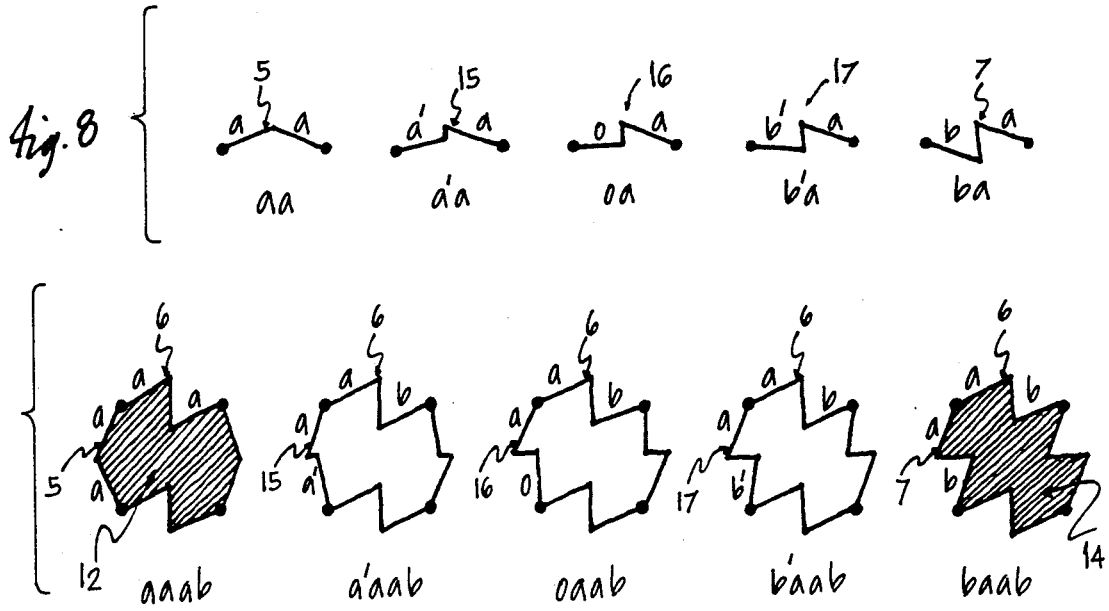

FIG. 9 shows the transformation of the tile (aaab) to (baab) through 3 intermediate stages as in FIG. 8. The sequence consists of 5 tiles in this case.

Figure 10:
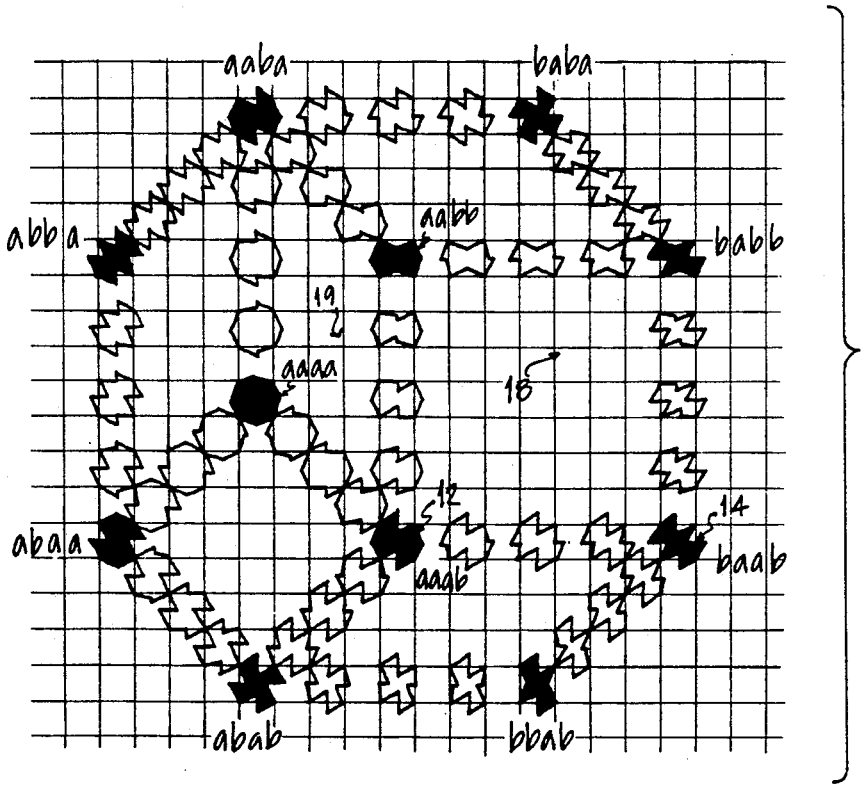

FIG. 10 shows the transformations between the 11 polygons (shown in black) of FIG. 7 through intermediate stages as in FIG. 9. The black polygons correspond exactly those in FIG. 7.

Figure 11:
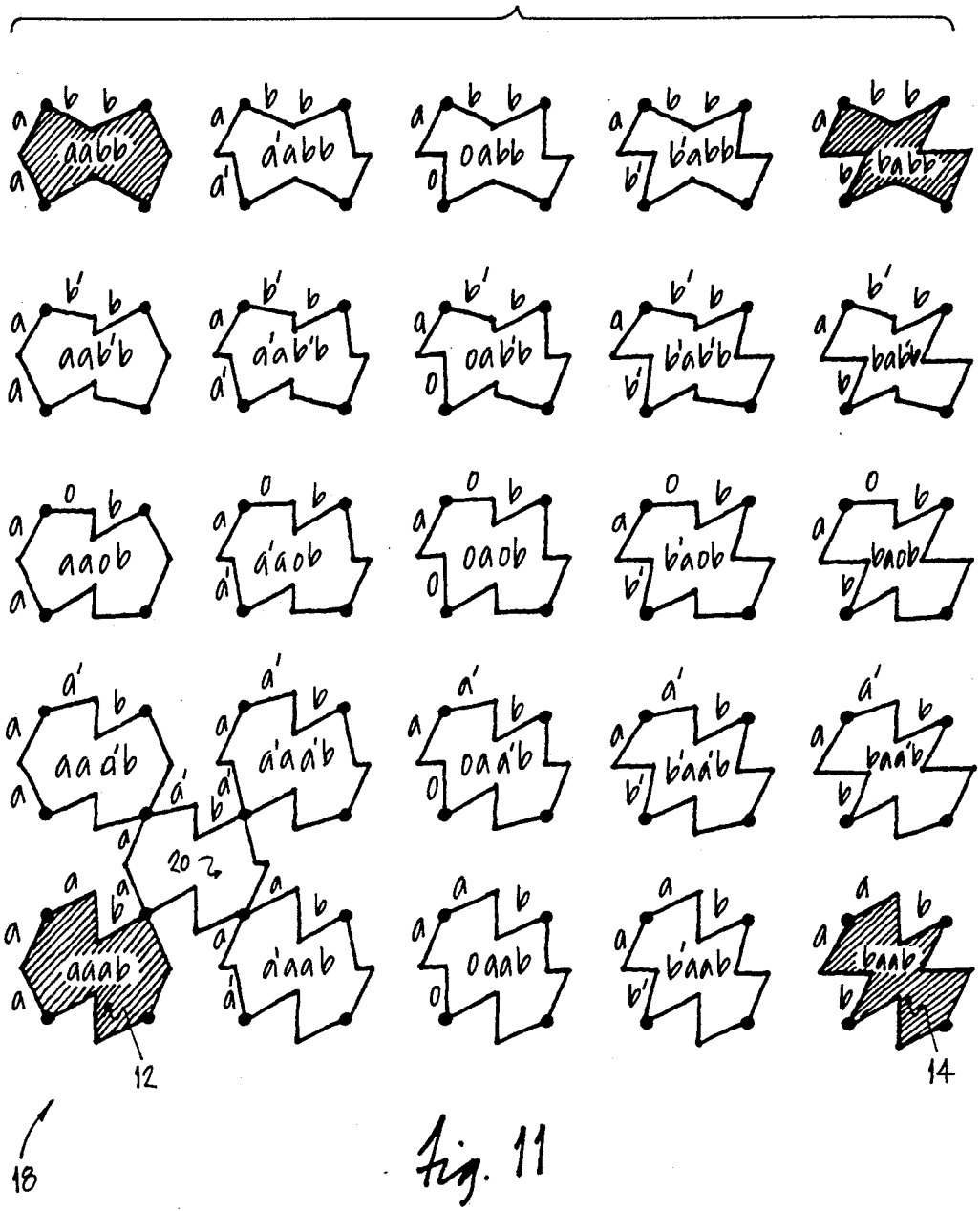

FIG. 11 shows the technique for filling-in the intermediates lying on one face of the zonohedron network. The square arrangement shown corresponds to the square region (or face) 18 of FIG. 10. The four corner polygons are shown shaded here. The tile 20 shows the way to fill in the remaining empty spaces.

Figure 12:
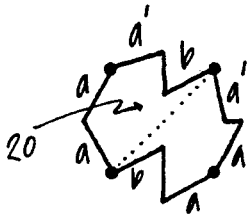

FIG. 12 shows a detail of the tile 20 of FIG. 11. Note that this tile loses its 2-fold symmetry.

Figure 13:
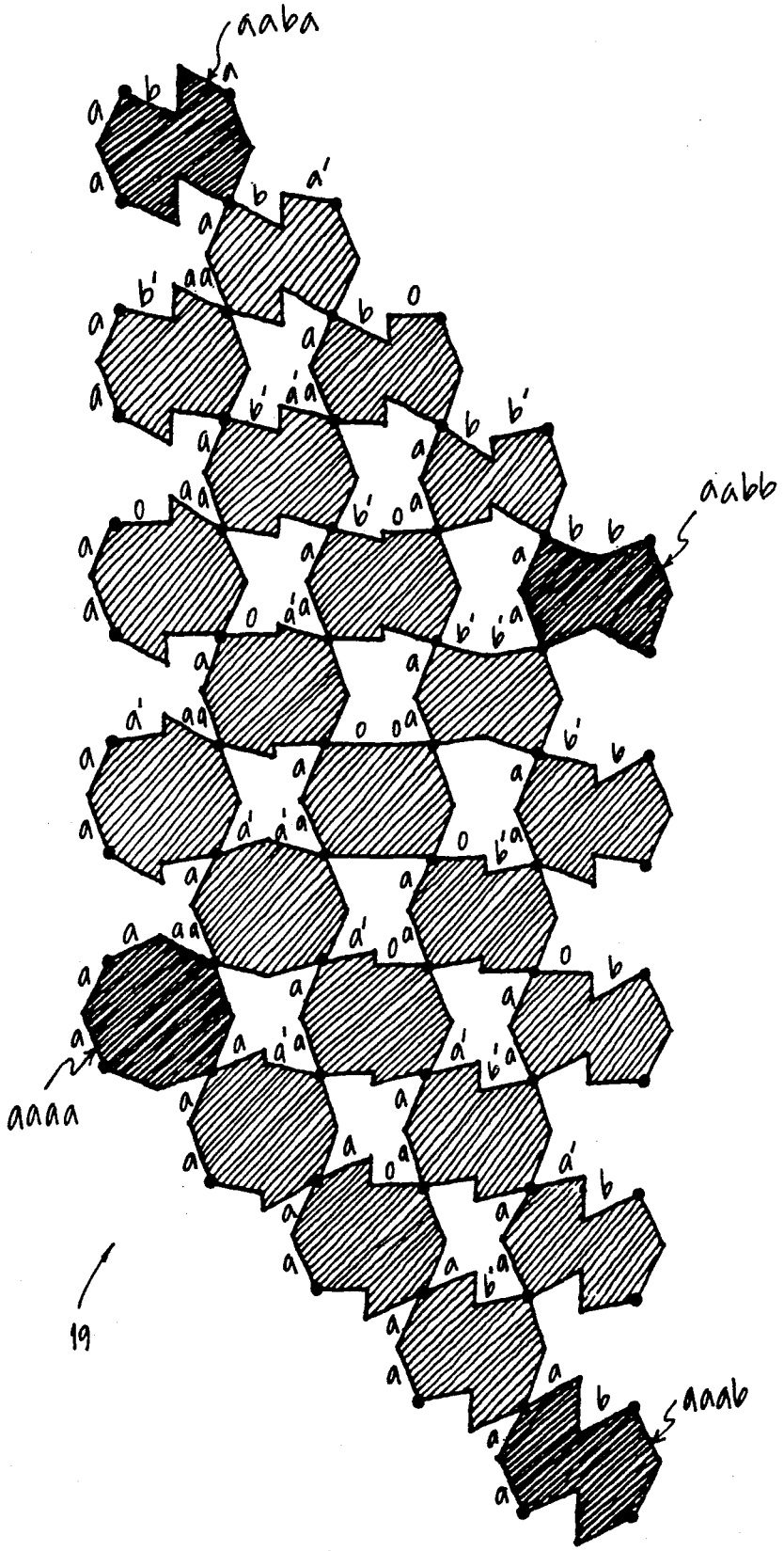

FIG. 13 shows the region 19 (another face of the zonohedron network) of FIG. 10 filled-in with intermediate polygons. All tiles are shown shaded to distinguish them from the left-over spaces.

Figure 14:
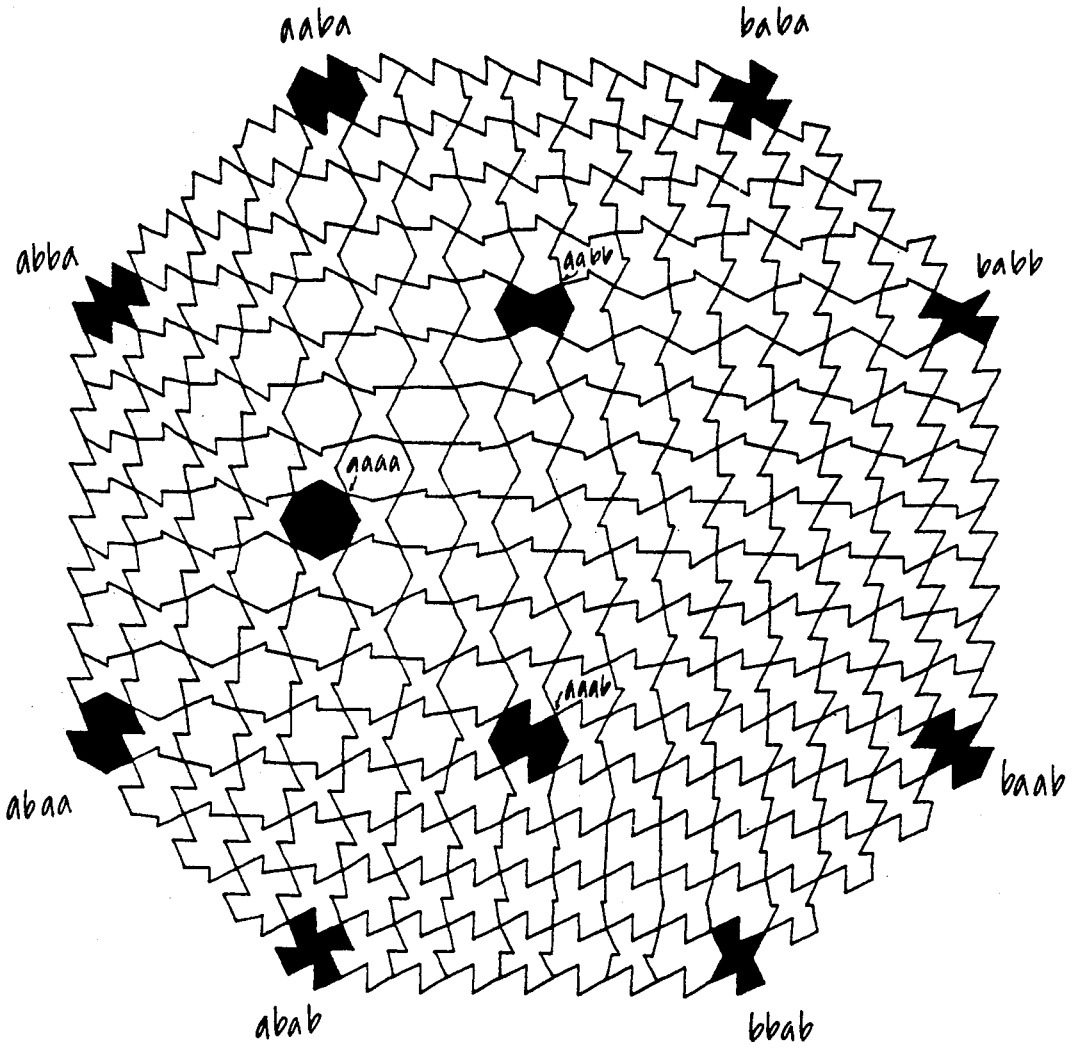

FIG. 14 shows the entire metamorphic tiling pattern by filling-in all the faces of the zonohedron of FIG. 10 with intermediate tiles. The 11 tiles of FIG. 7 are shown black. The pattern changes are in four different directions.

Figure 15:
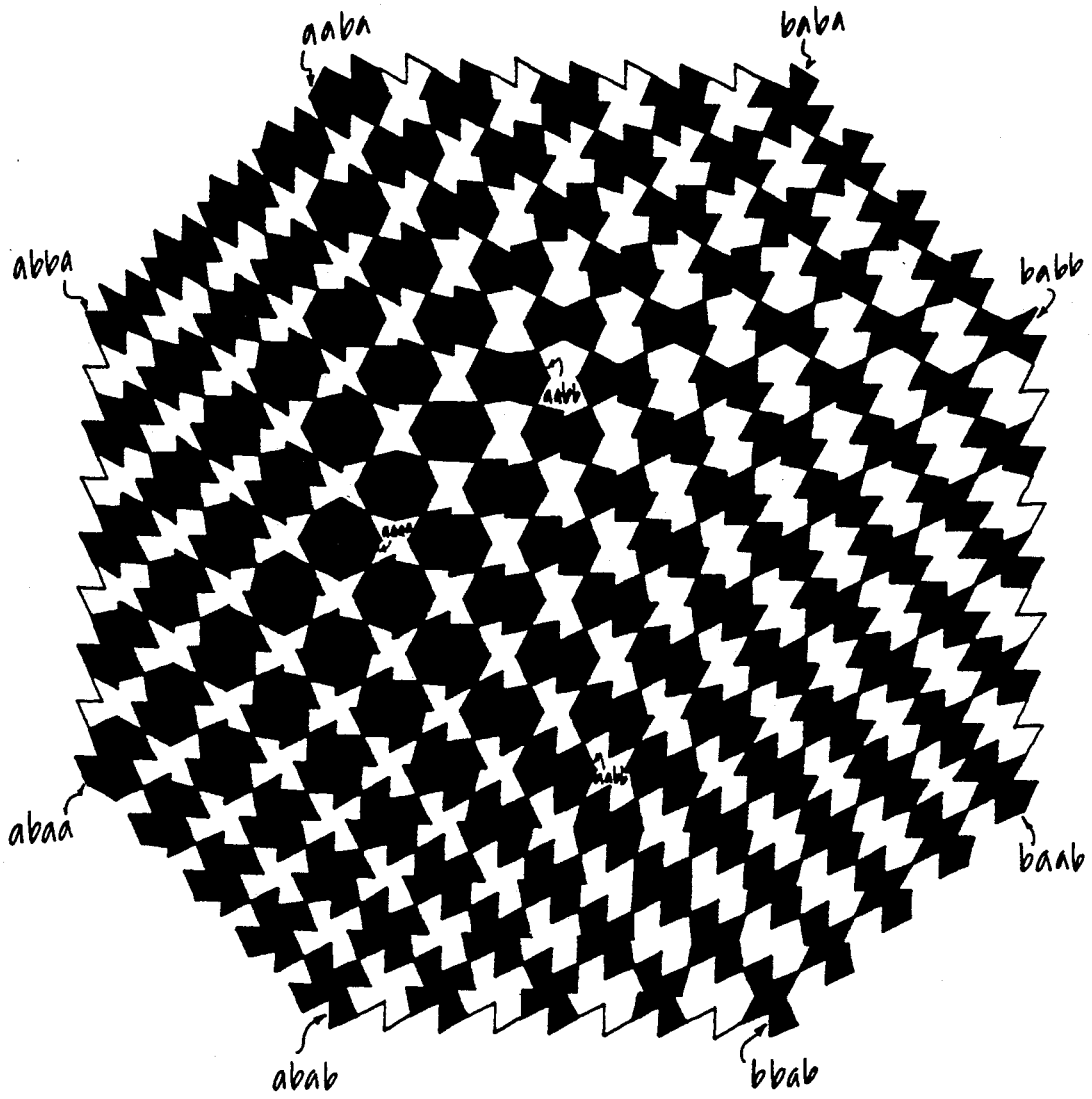

FIG. 15 shows the black-and-white checkerboard pattern obtained from FIG. 14. The metamorphosis between the 11 tiles of FIGS. 7 and 14 can be see better here. The pattern changes along four different directions specified by the zonohedron network based on a 4-dimensional cube.

Figures 16, 17, 18, 19, 20:
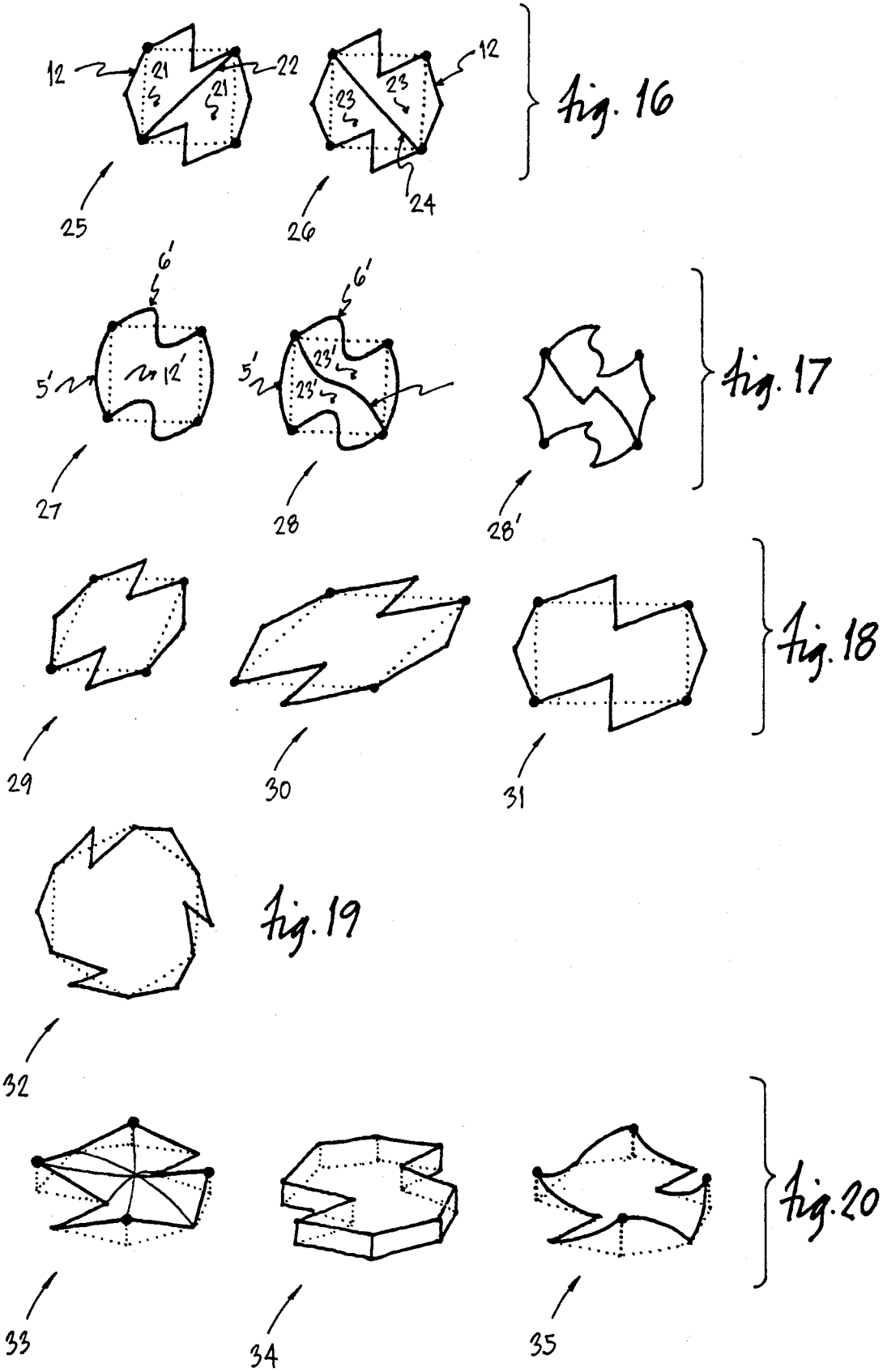

FIG. 16 shows the decomposition of a 4-sided polygon into two 3-sided polygons inserting a diagonal.

FIG. 17 shows the edges of the polygons being composed of smooth curves or curved line segments.

FIG. 18 shows the base polygon for the 4-sided tile could be a rhombus, a parallelogram or a rectangle instead of a square as in all previous examples.

FIG. 19 shows the application of the two-edge combination to a hexagon.

FIG. 20 shows the tile as a saddle surface polygon, a prism of any height, or having curved edges across the plane of the tile.

DETAILED DESCRIPTION OF THE INVENTION

As seen in FIG. 1, an edge of a polygon or polygonal tile, is "split" into left and right halves 1 and 2, and 3 and 4. In each case, the edge of a tile is determined by the two vertices (black dots) which it joins. In the figure, each half is shown in an up or down position. The up position of an half-edge is labelled (a), and the down position is labelled (b).

The half-edges of FIG. 1 are combined in FIG. 2 to produce full edges. The four combinations clearly are (aa), (ab), (ba) and (bb) and are shown as illustrations 5–8. In (ab) and (ba), the half-edges are joined by a small upright portion c thus making a continuous "edge". The definition of an "edge" is used here in topologic sense, i.e. an edge of a tiling joins 2 "vertices" (indicated by black dots in the illustrations) and is shared by only two adjacent polygons. Only at a "true" vertex (in a topologic sense), more than two polygons meet. Thus in the illustrations, the "kinks" in the edge are ignored as "false" vertices. Alternatively, a smooth curved edge would follow the same logic and could be used as an illustration; this variant will be shown later.

FIG. 2 thus shows four different (geometric) transformations on an (topologic) edge of a polygon. These four transformations will be used throughout to derive a class of polygons and their tilings. These four transformations are to be considered illustrative only and other types of transformations on the edges of polygons could be used following the same procedure disclosed in this application.

Now imagine a p-sided polygon. FIG. 2 shows four transformations on one of its edges. The same four transformations could be applied to an adjacent edge. This will generate a total of 16 two-edge combinations. These 16 are shown in the matrix 9 in FIG. 3. Each two-edge combination is labelled by four half-edges, and each half-edge is indicated. For example, the two-edge combination (aaaa) shown on the top left is composed of two edges 5. Similarly, on its right, is the double edge combination 10 composed of 5 and 6 and labelled (aaab). Proceeding further to the right, the edges 5 and 7 generate the combination (aaba) and the edges 5 and 8 generate (aabb). Similarly, all 16 can be identifed by the edge combinations and the associated labels.

In the matrix 9, the first pair of alphabets in the label stay constant as we scan horizontally from left to right in any row. For example, in the top row, (aa..) is constant in all four, in the second row from top (ab..) is constant through the four cases, in the third row from top (ba..) remains constant, and in the fourth row (bb..) is constant. Similarly, in each column, the second pair of alphabets of the label stay constant. In the first column from the left (..aa) is constant, in the second (..ab) is constant, and so on.

The two-edge configurations could be increased to 3, 4, 5 . . . p edges. If each edge has t transformations applied to it, the number of combinations equal $t^p$. In the present example in FIG. 3, $t=4$ and $p=2$, making a total of $4^2=16$ combinations as already shown. When p edges make a closed loop, p-sided polygons are obtained. Alternatively, polygons can be obtained by applying symmetry operations to lower values of p. For example, a reflection or a rotation of a two-edge pair can generate 4-edges. In FIG. 4, the two edge combination 10 (aaab) is reflected to produce a 4-sided polygon 11 which has a bilateral symmetry. The 4-sided polygon 12 is produced by a 2-fold rotation of 10 (i.e. through 180°) around the center O. For illustrative purposes, the present disclosure will show polygons obtained by a 2-fold rotation as in 12. The 16 two-edge configurations in matrix 9 are thus rotated to generate the corrsponding 16 polygons in the matrix 13 shown in FIG. 5. The four-alphabet label suffices since only one-half needs to be specified. The polygon 12 is seen in the top row, second from left. The four black dots in each polygon indicate a base square, and all polygons are topologically 4-sided since the false vertices due to the kinks in the edges are ignored as mentioned before. The matrix reads more clearly now. The left and right sides of the polygons stay constant in the horizontal direction, and the top and bottom sides stay constant in the vertical direction in the matrix.

An alternative to the matrix arrangement is to place the 16 polygons on the vertices of a 4-dimensional cube as shown in FIG. 6. The 4-dimensional cube (or 4-cube) has 16 vertices, and each is a distinct binary combination, like the combinations of transformations on the edges of the polygon. In the illustration, the 4-cube is shown in a 2-dimensional projection and is viewed along its 4-fold axis. The arrangement organizes the polygons into complementary pairs placed diametrically across one another. For example, (aaaa), located at 10 o'clock in the inner ring, is placed across the center from (bbbb) located at 4 o'clock, also in the inner ring. Similarly, the polygon (baba) located at 1 o'clock on the outer ring is diametrically across (abab) at 7 o'clock on the outer ring. Similarly, (aaba) is the complement of (bbab), (abba) is the complement of (baab), and so on.

In hyper-cubic arrangements, like the one shown in FIG. 6, the edges of the hype-cube cross over one another. The faces and cells of the hyper-cube overlap and inter-penetrate. From these, non-overlapping faces can be extracted to highlight only a few faces. One such arrangement is shown in FIG. 7. The octagonal profile is now subdivided into rhombii and the view corresponds to seeing the outer "shell" of the hyper-cube. This shell is called a "zonohedron", a polyhedron with parallel faces and composed of rhombii. FIG. 7 then shows 11 of the 16 polygons placed at the vertices of a zonohedron. The labels correspond in the two figures and FIG. 7 is completely embedded in FIG. 6.

The arrangement in FIG. 7 now provides the begining for generating a metamorphic tiling pattern, like the ones Escher did, but more complex and integrated by an underlying unifying binary (or Boolean) "structure" absent in Escher's metamorphoses. A step-by-step derivation of continuous transformations of the 11 polygons will now be described.

In FIG. 8, one example of a continuous transformation of the edge 5 (aa) to the edge 7 (ba) is shown in five stages. The two extremes are the edges 5 and 6, and three intermediates are introduced. In all five cases, the right half-edge remains unchanged, but the left half-edge changes. Proceeding from the left, intermediate edges 15, 16 and 17 are produced as the left half-edge in each changes from (a) to (a') to ($\alpha$) to (b') and finally to (b). The edge acquires a kink which goes on increasing. The five stages are shown for illustrative purposes only, and any number of intermediate stages can be introduced. The larger the number of stages in the sequence, the smoother the transformation from one stage to another.

The technique for continuous transformation of one edge in FIG. 8 is now applied to a polygon. FIG. 9 shows the continuous transformation of the polygon 12 (aaab) on the left, and composed of edges 5 and 6, to 14 (baab) on the right which is composed of edges 6 and 7. The three intermediate stages are (a'aab), (oaab) and (b'aab). The polygon (a'aab) is composed of edges 6 and 15, (oaab) is composed of 6 and 16 and (b'aab) is composed of 6 and 17. The top and bottom edges 6 remain unchanged in the transformation and the edges on the left and right sides transform exactly as per the sequence in FIG. 8. The two polygons 12 and 14 are among the eleven polygons in FIG. 7 (located towards the bottom right).

The step-by-step transformation between polygons can be applied to the entire set of 11 polygons in FIG. 7 and is shown in FIG. 10. The five stages of FIG. 9 are embedded in FIG. 10 and can be seen at the bottom (horizontal) row of the square region 18; this region is one of the face of the zonohedron network. The 11 polygons at the vertices of the zonohedron network are shown in black and correspond exactly to FIG. 7. All the transformations shown are linear transformations along the edges of the zonohedron network. In addition, the shapes of the tiles ar ebased on a base square grid overload on the hidden zonohedron network. Note that in th epresent example, this overlay changes the edge-lengths of the zonohedron network to the ration of 1 and /2(=1.414213 . . . ).

The faces of the zonohedron network can now be filled-in to generate a tiling pattern. The square region 18 of FIG. 10 is shown blown up in FIG. 11. The four corner polygons are shaded, the bottom row corresponds exactly to FIG. 9. The intermediate polygons in the interior of the zonohedron face is filled, in part, by generating rows and columns. The transformations along the rows and columns uses the same principle as that in the square matrices 9 and 13 shown earlier. Of the four-alphabet label, the first two alphabets, which correspond to the left and right sides of the polygon, remain unchanged in all the columns and the second pair of alphabets, corresponding to the top and bottom sides of the polygon, transforms in the same manner as FIG. 8. Similarly, in the rows, the top and bottom sides remain unchanged, and the left and right sides transform. The shapes and the labels can be inspected visually to see this "multiplication" pattern. Note that all the polygons retain their 2-fold symmetry.

The empty space between the rows and columns in FIG. 11 can now be filled in. This is shown with one intermediate tile 20 on the bottom left corner, and others canbe similarly derived. The tile 20 is shown separately in FIG. 12. Note that this tile has lost its 2-fold symmetry. The top side is (a'b) and the bottom is (ab), the left side is (aa) and the right is (a'a). The top-left half has the label sequence (aaa'b), and the bottom-right has the label (a'aab). The two "halves" are no longer symmetrical.

The same technique of filling-in the empty spaces can be applied to the paralellogram region 19 of FIG. 10; this region is another face of the zonohedron network with edges in the ratio 1 and /2, and contained pair of complementary angles 45° and 135°. Here the columns follow as before, but the rows are inclined at 45° to the horizontal. All edges are labelled to follow the transformation process and can be inspected visually.

All the empty regions and spaces in FIG. 10 can be similarly filled. A complete metamorphic tiling pattern obtained this way is shown in FIG. 14. The 11 blackened polygons at the vertices of the hidden zonohedron remain the same as before. The entire pattern can be converted into a black-and-white checkerboard pattern as shown in FIG. 15. The metamorphosis in four different directions, determined by the underlying zonohedron (and the 4-cube), can be seen as the patterns changes its "direction" as we move through the tiling.

The above example was used as an illustration to show the technique of derivation in this application. The technique is a general one and a few variations on the theme are suggested. Clearly many more metamorphic patterns can be generated using this method. For example, the 4-sided polygons can be dissected by a diagonal into two 3-sided polygons (triangles, in a topologic sense) as shown in FIG. 16. 25 shows the polygon 12 bisected into two 3-sided polygons 21 by the diagonal 22. 26 shows the same polygon 12 bisected by the other diagonal 24 into two 3-sided polygons 23.

The edges can be composed of several curved line segments or smooth curves as shown in FIG. 17. 27 shows a curved variant 12' of the polygon 12 composed of edges 5' and 6' which are curved versions of the kinky edges 5 and 6. 28 shows a curved variant of 26 divided into two triangles 23' which are topologically same as 23. The diagonal 24' as also curved. 28' shows a 4-sided polygonal tile with edges composed of curved line segments.

The 4-sided polygons can be based on a rhombus or a parallelogram instead of a square as used in all previous examples. Three variants of the polygon 12 are shown in FIG. 18. 29 is based curving the edges of a rhombus. 30 is based on a parallelogram and 31 is based on a rectangle. The base polygons are shown dotted in each case.

The two-edge combinations of FIG. 3 could be applied to any even-sided polygon. An example of the application of edge-pair (aaab) to a hexagon is shown in FIG. 19. 32 is based on a regular hexagon though any 6-sided zonogon could be used.

The tiles could be made 3-dimensional in several ways as shown with two examples in FIG. 20. 33 is obtained by zig-zagging the edges of the polygon 12, shown here in dotted line in an isometric view. The surface could be covered by a saddle surface which can be curved as shown, or be composed of triangles. In 34, the tile 12 is shown as a prism of any height. A variant could use a prism truncated at any angle as long as the top plan view corresponds to the tile shape. In 35, the tile 12 is shown with curved edges which are out of the plane of the tile as in 33.

Further, the number of transformations can be increased from 4 to n, where n is any integer. The polygons based on combinations of n transformations can be arranged on the vertices of an n-cube. From this other zonohedra can be derived in a manner similar to the one described here, and can be used as a basis for generating other metamorphic tiling patterns. The face angles of parallelograms in other zonehedral networks are multiples of 180°/n and are always in the 2-dimensional projection viewed along the n-fold axis of symmetry. Applications to surface subdivisions of zonohedra in 3-dimensions can be derived by analogy.

What is claimed as new is:

1. A method of producing metamorphic tiling patterns for various design applications and comprising:

a plurality of transformed polygons derived from a base tiling pattern composed of plane-filling base polygons wherein said transformed polygons are obtained by applying geometric transformations on the edges of said base polygons wherein each said transformed polygon is a geometric transformation of the adjacent transformed polygon and said plurality of transformed polygons displays a gradual transformation of the tiling pattern from one portion of the pattern to another, where said geometric transformations are binary combinations of n distinct geometric transformations performed on edges of said base polygons, where the said plurality of said transformed polygons cover a surface of an underlying zonohedron network composed of contiguous parallelogram faces and defined by a projection of an n-dimensional cube having edges parallel to n directions, such that each direction is coupled with an associated geometric transformation, and where n is any number greater than 3, where the said metamorphic tiling pattern is derived by using the method steps comprising the following:

selecting said base tiling pattern composed of plane-filling 4-sided base polygons of desired proportions and angles, projecting said n-dimensional cube onto said base tiling pattern, identifying sets of said base polygons as vertex-polygons corresponding to the vertices of said projected n-dimensional cube, edge-polygons corresponding to the edges of said projected n-dimensional cube, and face-polygons corresponding to all remaining polygons which are not vertex- and edge-polygons, performing a first transformation on each said vertex-polygon whereby n independent geometric transformations are selected and their combinations applied to all said vertex-polygons thereby creating a set of transformed vertex-polygons, selecting a sub-set of said transformed vertex-polygons corresponding to the vertices of said contiguous parallelogram faces of said zonohedron network, performing a second transformation whereby all said edge-polygons corresponding to the edges of the said zonohedron network are transformed by gradual incremental transformations between said transformed vertex-polygons thereby creating a set of transformed edge-polygons, performing a third transformation whereby all said face-polygons corresponding to the faces of the said zonohedron network are transformed by gradual incremental transformations between said transformed vertex- and edge-polygons, where said method steps are applied systematically over the entire surface of the said zonohedron network to generate said metamorphic tiling pattern.

2. A method of creating metamorphic tiling patterns according to claim 1, wherein said zonohedron network is based on a 2-dimensional projection of said n-dimensional cube.

3. A method of creating metamorphic tiling patterns according to claim 1, wherein said zonohedron network is based on a 2-dimensional projection of a 4-dimensional cube viewed along its 4-fold axis of symmetry and its edges are in the ratio of 1 to square root of 2 (or 1.414213 . . . ).

4. A method of creating metamorphic tiling patterns according to claim 1, wherein the said geometric transformations on said base polygons include curving the edges along the plane of said base polygons.

5. A method of creating metamorphic tiling patterns according to claim 1, wherein the said geometric transformations on said base polygons include curving the edges perpendicular to, or at any angle to, the plane of said base polygons.

6. A method of creating metamorphic tiling patterns according to claim 1, wherein the said geometric transformations on said base polygons include curving the said edges inwards, outwards or combination of both inwards and outwards.

7. A method of creating metamorphic tiling patterns according to claim 1, wherein the said curving of the edges of said base polygons is composed of several straight line segments.

8. A method of creating metamorphic tiling patterns according to claim 1, wherein the said curving of the edges of said base polygons is composed of several curved line segments.

9. A method of creating metamorphic tiling patterns according to claim 1, where the said curving of the edges of said base polygons is composed of combinations of straight line and curved line segments.

10. A method of creating metamorphic tiling patterns according to claim 1, wherein the said curving of the edges of said base polygons is a smooth curve.

11. A method of creating metamorphic tiling patterns according to claim 1, wherein the said curving of the edges of said base polygons is regular or irregular.

12. A method of creating metamorphic tiling patterns according to claim 1, wherein the said 4-sided base polygons of said base tiling pattern are dissected with a diagonal to produce 3-sided polygons.

13. A method of creating metamorphic tiling patterns according to claim 1, wherein the said 4-sided base polygons of said base tiling pattern are based on a square.

14. A method of creating metamorphic tiling patterns according to claim 1, wherein the said 4-sided base polygons of said base tiling pattern are based on a rectangle.

15. A method of creating metamorphic tiling patterns according to claim 1, wherein the said 4-sided base polygons of said base tiling pattern are based on a parallelogram of any angle and lengths.

16. A method of creating metamorphic tiling patterns according to claim 1, wherein the said 4-sided base polygons of said base tiling pattern are based on any rhombus or combination of rhombii.

17. A method of creating metamorphic tiling patterns according to claim 1, wherein the said base polygons are extruded into upright or inclined prisms of any height.

18. A method of creating metamorphic tiling patterns according to claim 1, wherein the said transformed polygons are curved surfaces shaped as saddle-shaped polygons.

19. A method of creating metamorphic tiling patterns according to claim 1, wherein the said transformed vertex-polygons can be colored in binary combinations of n colors and remaining transformed polygons have continually graded colors.

* * * * *